US006232556B1

(12) United States Patent
Daugherty et al.

(10) Patent No.: US 6,232,556 B1
(45) Date of Patent: May 15, 2001

(54) FLAT WIRE TO ROUND WIRE CONNECTION SYSTEM

(75) Inventors: James D. Daugherty, Brookfield; Nick M. Loprire, Cortland, both of OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/511,518

(22) Filed: Feb. 23, 2000

(51) Int. Cl.[7] ..... H01R 4/02
(52) U.S. Cl. ..... 174/88 R; 439/874
(58) Field of Search ..... 174/88 R, 117 F, 174/92, 138 F; 439/874, 499

(56) References Cited

U.S. PATENT DOCUMENTS 4,564,256 1/1986 Damiano et al. .
4,682,840 * 7/1987 Lockard ..... 439/874
5,057,650 * 10/1991 Urushibata et al. ..... 174/88 R
5,683,259 * 11/1997 Sato ..... 439/164
5,780,774 * 7/1998 Ichikawa et al. ..... 174/88 R

* cited by examiner

*Primary Examiner*—Dean A. Reichard
*Assistant Examiner*—Chau N. Nguyen
(74) *Attorney, Agent, or Firm*—Patrick M. Griffin

(57) ABSTRACT

An electrical connector forms a permanent electrical connection between a flat cable having multiple conductors and a plurality of round wires. The connector comprises a first connector half and a second connector half. The first connector half has a flat cable channel and at least one flat cable access window in communication with the flat cable channel. The second connector half has a plurality of wire channels for receiving round wires, and at least one wire access window in communication with one of the wire channels. Each cable access window is aligned with at least one wire access window to facilitate a permanent connection between a conducting strip of the multiple conductor flat cable and a conducting core of the round wire.

20 Claims, 2 Drawing Sheets

FLAT WIRE TO ROUND WIRE CONNECTION SYSTEM

BACKGROUND OF THE INVENTION

The present invention relates generally to electrical connectors, and more specifically to electrical connectors for splicing flat cables having multiple conductors to a plurality of round wires.

In typical applications where space is limited, there exists need to provide a permanent connection from a flex circuit, flat wire, or some other ribbon type multiple conductor cable to a plurality of round wires. An example of this need is present in the automotive industry where space is limited, as in headliners, door panels and instrument panels. Currently, where a transition from a flat cable having multiple conducting elements to multiple round wires is required, a connection system or a crimp system is used.

The methods used for splicing flexible printed circuits or flat wire cables to individual round wires include crimped connection systems, crimped splices and blade connection systems. A common disadvantage shared by these systems is that the systems incorporate a connecting element to secure the desired conductors. Crimped splices and crimped connection systems incorporate an element which is typically deformed to secure the conductors. A blade connection system incorporates an interface which is driven through the insulation of the wires to be joined.

U.S. Pat. No. 4,564,256 to Damiano, et al. discloses an electrical connector having a plurality of blade connectors for achieving electrical conduction between conductors within a flat cable and round wires. However, insulation displacement blade connectors must pierce the insulating material surrounding the conducting element and therefore may fail to make electrical contact with one or both conducting elements.

Another deficiency with the prior art is that crimped connection systems and blade connection systems require a connecting element that requires valuable space. Also, crimped connection systems require the step of deforming the connecting elements. Furthermore, the connecting elements may fail to properly secure the conducting elements.

Therefore, there exists a need in the prior art to provide a simple, low profile and inexpensive connector for joining a flex circuit, flat wire or some variation of a flat multiple conductor cable to a round wire, without incorporating a connecting element, to achieve an electrical connection between the conductors.

SUMMARY OF THE INVENTION

An object of the present invention is to provide a connector for creating a permanent electrical connection, comprising a first connector half and a second connector half. The first connector half has a flat cable channel for receiving a multiple conductor flat cable. The first connector half has at least one flat cable access window disposed within the flat cable channel. A second connector half has a plurality of wire channels, each of the wire channels are provided to receive a round wire. At least one wire access window is disposed within the second connector half in communication with at least one wire channel. Each cable access window is aligned with at least one wire access window to facilitate a permanent connection between each conducting element of a multiple conductor flat cable and a conducting element of a round wire when the first connector half is operatively aligned with the second connector half.

A feature of the present invention is the elimination of connecting elements used in the prior art, such as crimped terminals, by providing a permanent splice connection.

Another feature of the present invention is that the connector is a simple, low profile and inexpensive device for joining a multi-element flat cable, such as a flex circuit, flat wire or ribbon cable to a round wire.

Yet another feature of the present invention is to provide an electrical connector where no auxiliary metal parts are required.

Still yet another feature of the present invention is to provide an electrical connector which assures proper alignment of the conducting elements.

Still yet another feature of the present invention is to provide an electrical connector where the connector joint has sufficient strain relief.

Still yet another feature of the present invention is to provide an electrical connector which has adequate access to the conductor joint where joining the conductors may be accomplished by utilizing a commonly used joining technology, including: welding, sodering or gluing.

Other objects and features of the present invention will become apparent to those skilled in the art from the following detailed description of a preferred embodiment of the invention which sets forth the best mode of the invention contemplated by the inventors and which is illustrated in the accompanying sheets of drawings.

DESCRIPTION OF THE PREFERRED EMBODIMENT

Figure 1:
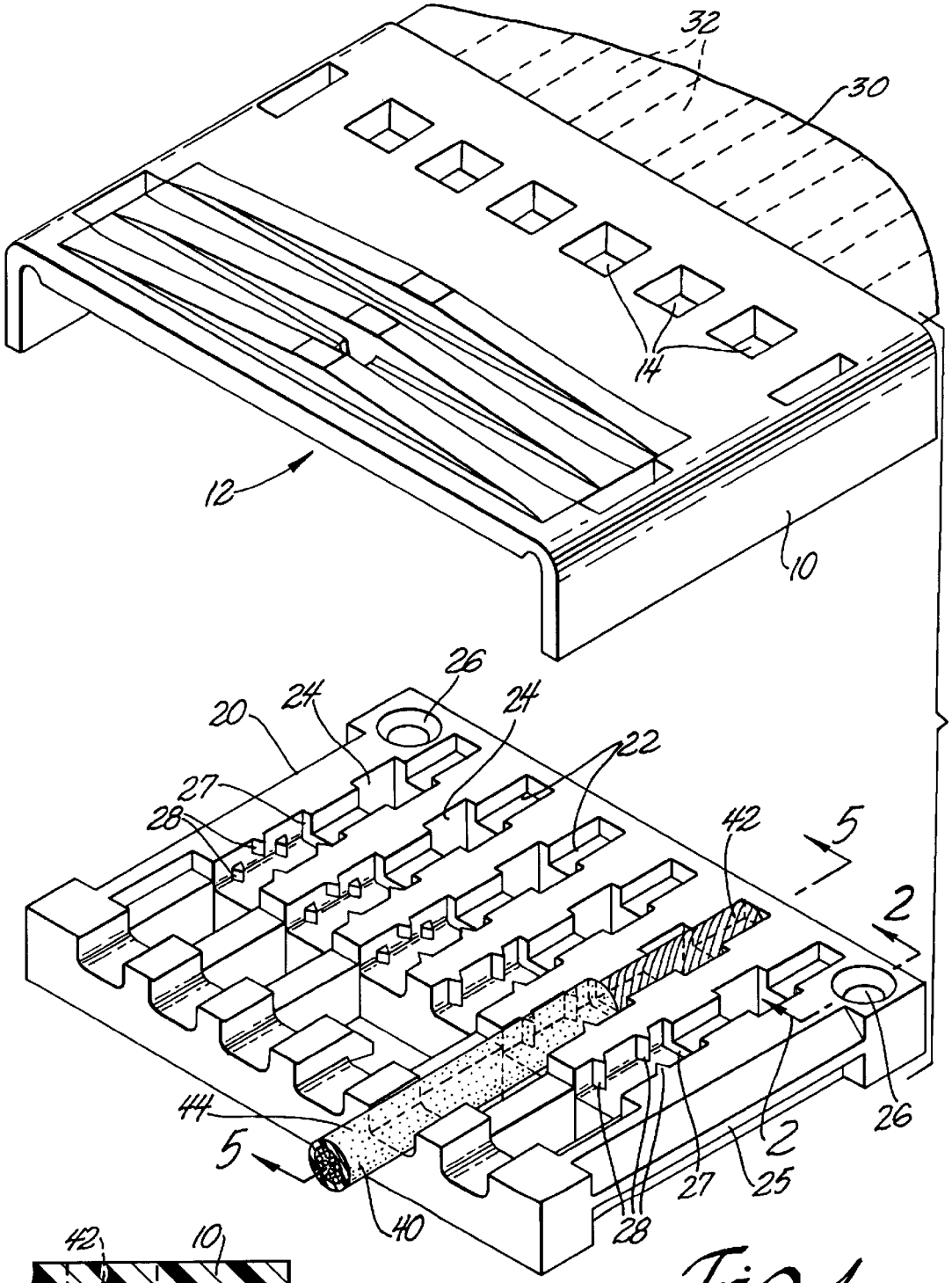
FIG. 1 is an exploded isometric view revealing a first half and second half of the electrical connector of the present invention.
Figure 2:
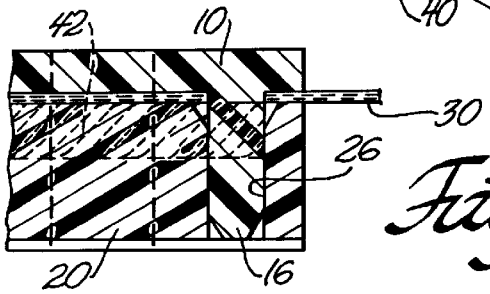
FIG. 2 is a section taken substantially along the line 2—2 of FIG. 1 looking in the direction of the arrows.

Referring now to FIG. 1, an exploded isometric view of a connector 1 for creating a permanent electrical connection comprises a first connector half 10 and a second connector half 20. The first connector half 10 has a flat cable channel 12 that receives a multiple conductor flat cable 30. The second connector half 20 has a plurality of wire channels 22. Each wire channel 22 may receive one of a plurality of round wires 40. In the exemplary embodiment of FIG. 1, a plurality of flat cable access cable windows 14 are disposed within the first connector half 10 in communication with the flat cable channel 12. However, it should become apparent to those skilled in the art that as few as one flat cable access window 14 may be provided to achieve the result obtained by a plurality of flat cable access windows 14.

A plurality of wire access windows 24 are disposed within the second connector half 20. Each wire access window 24 is in communication with at least one of the wire channels 22. However, it should become apparent to those skilled in the art that as few as one wire access window 24 is sufficient to achieve the desired result of the plurality of wire access windows 24.

Figure 3:
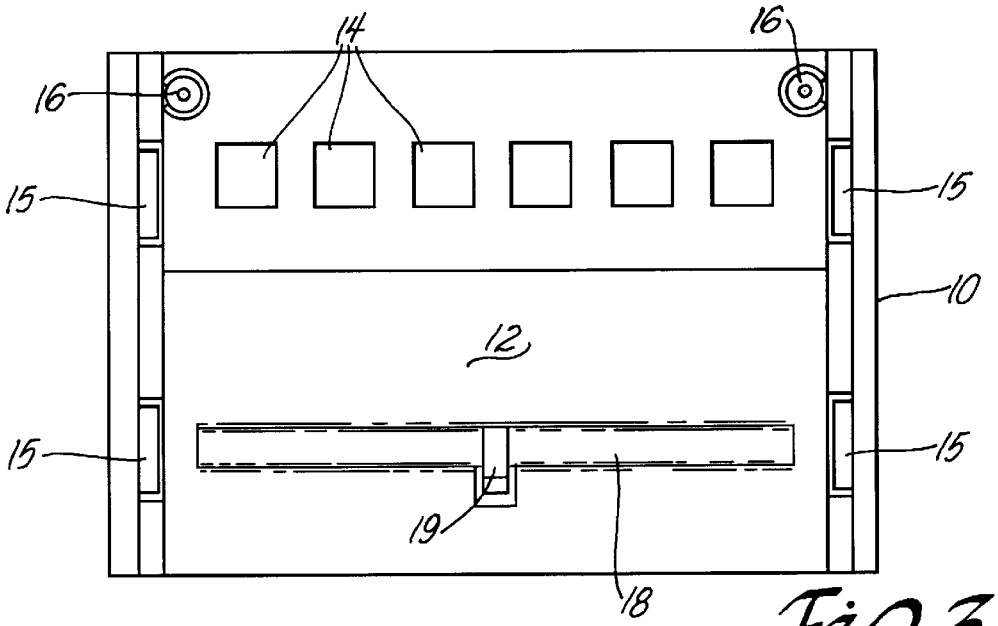
FIG. 3 is a bottom view of the first connector half of the present invention.
Figure 4:
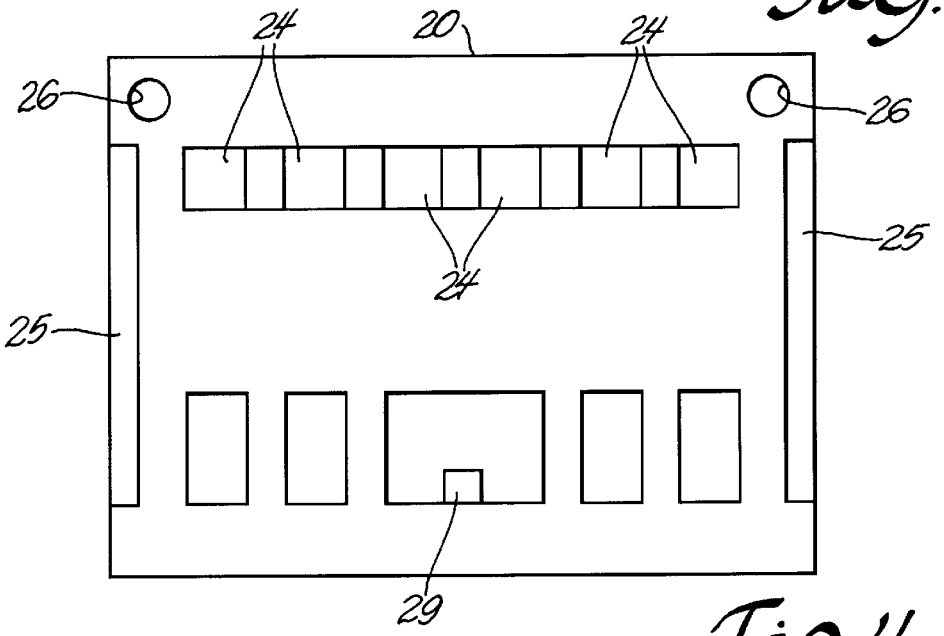
FIG. 4 is a top view of the second connector half of the present invention.

Referring now to FIG. 3, a bottom view of the first connector half 10 is shown. A pair of locating pins 16 extend into the cable channel 12 of the first connector half 10 to provide strain relief to the multiple connector flat cable 30 by restricting the lateral and axial movement of the cable 30. The locating pins 16 also provide alignment to the cable 30 by locating the cable 30 within the flat cable channel 12. Referring also to FIG. 4, at least two pilot holes 26 are disposed within the second connector half 20. The pilot holes 26 receive the locating pins 16 to align the first connector half 10 with the second connector half 20.

Referring now to FIG. 1, an isometric view of the second connector half 20 is shown. Each of the plurality of wire channels 22 has a wire locating stop 27 for positioning a round wire 40. In the preferred embodiment, each of the plurality of wires 40 has a portion of insulating material 44 removed to reveal a conducting core 42. The wire locating stop 27 shoulders against the insulting material 44 to locate the round wire 40 within the wire channel 22. A wire retainer 28 is disposed within each wire channel 22 to maintain the position of the round wire 40 during assembly. In the preferred embodiment, the wire retainer 28 is formed by a plurality of teeth located within each wire channel 22. However, it should become apparent to those skilled in the art that numerous substitutes exist in the art for retaining round wires and are contemplated to be within the spirit and scope of the present invention.

Referring again to FIG. 3, a strain relief rib 18 is disposed within the first connector half 10 to prevent damage to an electrical connection formed between flat conducting strips 32 of the multiple conductor flat cable 30 and each conducting core 42 of one of a plurality of round wires 40. The locating pins 16 provide a similar benefit to the electrical connection between the flat cable 30 and plurality of round wires 40 by reducing lateral and axial movement of the flat cable 30 within the flat cable channel 12.

Figure 5:
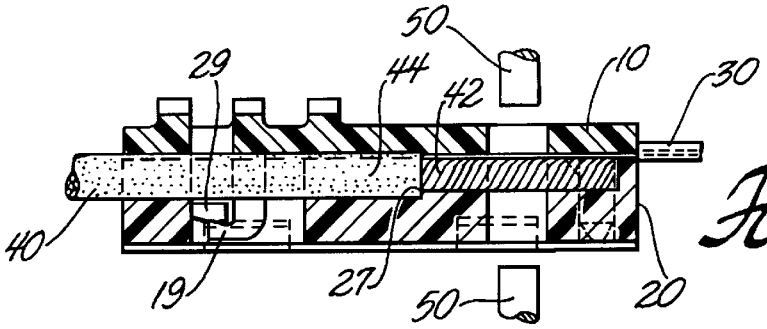
FIG. 5 is a section taken substantially along the line 5—5 of FIG. 1 looking in the direction of the arrows.

Referring now also to FIG. 5, a lock arm 19 of connector half 10 extends into a window of the second connector half 20, and engages a lock tab 29 of the second connector half 20. Engagement of the lock arm 19 with the lock tab 29 prevents the first connector half 10 and second connector half 20 from bowing away from each other at the aft end.

In the exemplary embodiment, two pairs of lateral retainer tabs 15 extend inwardly from the side walls of the first connector half 10. A pair of retainer rails 25 extend outwardly from the side walls of the second connector half 20 as best shown in FIG. 1. Each pair of retainer tabs 15 snap over one of the retainer rails 25 to fasten the first connector half 10 and the second connector half 20 together. Although the preferred embodiment discloses two pairs of lateral retainer tabs 15, it should become apparent to those skilled in the art that a single lateral retainer tab on each side wall may be employed to achieve the desired results of securing the first connector half 10 to the second connector half 20.

The first connector half 10 is operatively aligned with the second connector half 20 by the locating pins 16. Although the first connector half 10 and second connector half 20 maybe operatively aligned by any means known in the art, specific examples are disclosed herein that illustrate a preferred method to align the first connector half 10 to the second connector half 20. Each cable access window 14 is aligned with at least one corresponding wire access window 24 to facilitate a permanent connection between each conducting strip 32 of multiple conductor flat cable 30 and a conducting core 42 of one of the plurality of round wires 40. Each conducting core 42 of round wire 40 is registered with a conducting strip 32 of a multiple conductor flat cable 30.

Any suitable method known in the art for joining the conducting strip 32 to conducting core, 42 may be employed, including: molding, welding, soldering and gluing. In the preferred embodiment the conducting elements 32, 42 are joined by sonic welding. Windows 14, 42 provide access for sonic welding tools 50 to engage the conducting elements 32, 42 as best shown in FIG. 5.

The present invention provides a connector for joining a multiple conductor flat cable 30 to a plurality of round wires 40. Multiple conductor flat cable as referred to herein is intended to include a flex circuit, flat wire, ribbon cable or any variation thereof. The present invention provides a permanent connection between the conducting strip 32 of a multiple conductor flat cable 30 and a conducting core 42 of a round wire 40 without requiring an additional connector such as a terminal crimp or an interface such as a blade connector.

The first connector half 10 and second connector half 20 may be molded from plastic. No auxiliary metal parts are required for the connector 1 of the present invention. Furthermore, less space is occupied by the connector 1 of the present invention than by crimp splices or a connection system. By eliminating components such as crimp splices or a connection system, and the resulting handling and assembly thereof, manufacturing cost is reduced.

The foregoing description discloses and describes various embodiments of the present invention. One skilled in the art will readily recognize from the above description, the background, the accompanying drawings and claims, that various changes, modifications and variations can be made without departing from the spirit and scope of the present invention, and also such modifications, changes and variations are intended to be included within the scope of the following claims.

We claim:

1. A connector for creating a permanent electrical connection, comprising:

a first connector half having a flat cable channel for receiving a multiple conductor flat cable;

at least one flat cable access window disposed within the first connector half in communication with the flat cable channel;

a second connector half having a plurality of wire channels, each of the wire channels for receiving a round wire; and at least one wire access window disposed within the second connector half in communication with at least one of the wire channels, the at least one flat cable access window being aligned with the at least one wire access window to facilitate a permanent connection between a conducting strip of a multiple conductor flat cable and a conducting core of said round wire when the first connector half is operatively aligned with the second connector half.

2. The connector as in claim 1, further comprising at least two locating pins extending from the first connector half for locating and strain relieving a multiple conductor flat cable.

3. The connector as in claim 2, further comprising at least two pilot holes disposed within the second connector half for receiving the locating pins to align the first connector half with the second connector half.

4. The connector as in claim 1, wherein said conducting core of the round wire received in said each of the wire channels is registered with said conducting strip of the multiple conductor flat cable received in the flat cable channel.

5. The connector as in claim 1, further comprising a wire-locating stop disposed within each of the wire channels for positioning said round wire.

6. The connector as in claim 1, further comprising a wire retainer disposed within each of the wire channels for maintaining the position of said round wire during assembly.

7. The connector as in claim 1, further comprising a strain relief rib disposed within said first connector half to prevent damage to the electrical connection.

8. The connector as in claim 1, further comprising an interior lock arm extending from the first connector half for engaging a lock tab disposed within said second connector half, whereby said first connector half and said second connector half are prevented from bowing.

9. The connector as in claim 1, further comprising at least one pair of lateral retainer tabs extending inwardly from side walls of the first connector half, a pair of retainer rails extending outwardly from side walls of the second connector half, each of the retainer tabs snapping one of the pair of retainer rails to fasten the first connector half and the second connector half together.

10. The connector as in claim 1, wherein the permanent connection is achieved by sonic welding.

11. The connector as in claim 1, wherein the permanent connection is achieved by laser welding.

12. A connector for creating a permanent electrical connection, comprising:

a first connector half having a flat cable channel receiving a multiple conductor flat cable having a plurality of conducting strips;

a plurality of cable access windows disposed within the first connector half, the plurality of cable access windows being in communication with the flat cable channel, each of the plurality of cable access windows being in registration with one of the plurality of conducting strips;

a second connector half including a plurality of wire channels for receiving a plurality of round wires; and a plurality of wire access windows disposed within the second connector half, each of the plurality of wire access windows being in communication with one of the plurality of wire channels and aligned with one of the plurality of cable access windows to facilitate a permanent connection between the conducting strips of the multiple conductor flat cable and conducting cores of the plurality of round wires when the first connector half is operatively aligned with the second connector half.

13. The connector of claim 12, further comprising at least two locating pins extending from the firs t connector half for locating and strain relieving the multiple conductor flat cable.

14. The connector of claim 13, further comprising at least two pilot holes disposed within the second connector half for receiving the locating pins to position the first connector half with the second connector half.

15. The connector as in claim 12, wherein the conducting cores are registered with respective ones of the plurality conducting strips of the multiple conductor flat cable.

16. The connector as in claim 12, further comprising wire-locating stops disposed within the wire channels for positioning the plurality of round wires within the wire channels.

17. The connector as in claim 12, further comprising wire retainers disposed within the wire channels for maintaining the position of the plurality of round wires during assembly.

18. The connector as in claim 12, further comprising a strain relief rib disposed within the first connector half to prevent damage to the electrical connection.

19. The connector as in claim 12, further comprising an interior lock arm extending from said first connector half and engaging a lock tab disposed within said second connector half, whereby the first connector half and the second connector half are prevented from bowing.

20. The connector as in claim 12, further comprising at least one pair of lateral retainer tabs extending inwardly from side walls of the first connector half, a pair of retainer rails extending outwardly from side walls of the second connector half, each of the retainer tabs snapping one of the pair of retainer rails to fasten the first connector half and the second connector half together.

* * * * *